United States Patent [19]

Heylen et al.

[11] Patent Number: 4,715,500

[45] Date of Patent: Dec. 29, 1987

[54] LIGHT-SENSITIVE PHOTOGRAPHIC FILM PACKAGING

[75] Inventors: Raymond A. Heylen, Grobbendonk; Marc J. Boets, Edegem, both of Belgium

[73] Assignee: Agfa-Gevaert N.V., Mortsel, Belgium

[21] Appl. No.: 881,003

[22] Filed: Jul. 1, 1986

[30] Foreign Application Priority Data

Jul. 12, 1985 [EP] European Pat. Off. ... EP 85201167.5

[51] Int. Cl.[4] ..... B65D 27/10; B65D 85/67

[52] U.S. Cl. ..... 206/397; 206/455

[58] Field of Search ..... 206/390, 397, 395, 408, 206/455; 53/430; 156/257; 229/17 S

[56] References Cited

U.S. PATENT DOCUMENTS

| | | | |
|---|---|---|---|
| 2,373,092 | 4/1945 | Avery | 229/17 S X |
| 2,830,910 | 4/1958 | Swanson | 206/390 X |
| 3,458,109 | 7/1969 | Compton et al. | 206/408 X |
| 3,835,992 | 9/1974 | Adams, IV | 206/390 |
| 3,921,802 | 11/1975 | Thompson | 206/390 X |
| 3,941,246 | 3/1976 | Duden | 206/455 |
| 3,991,878 | 11/1976 | Serio, Jr. et al. | 206/408 X |
| 4,173,293 | 11/1979 | Hamisch, Jr. et al. | 206/390 X |
| 4,475,969 | 10/1984 | Reed | 156/257 X |
| 4,575,988 | 3/1986 | Meier | 206/455 |

FOREIGN PATENT DOCUMENTS

| | | | |
|---|---|---|---|
| 716443 | 8/1965 | Canada | 206/397 |
| 0000227 | 1/1979 | European Pat. Off. . | |

*Primary Examiner*—Horace M. Culver

*Attorney, Agent, or Firm*—William J. Daniel

[57] ABSTRACT

A photographic film storage and dispensing package, which comprises an elongated light-tight box (10), a core (19) that is rotatably journalled between flanges (14) in the box, a web (22) of light-impervious paper that is wound onto said core and a plurality of undeveloped sheets (23) of light-sensitive photographic material that are interwound in closely spaced apart succession together with said web onto the core. The box has an openable cover on one side parallel to the core axis which when opened permits the web to be unwound and the individual sheets delivered one by one out of the box.

5 Claims, 4 Drawing Figures

LIGHT-SENSITIVE PHOTOGRAPHIC FILM PACKAGING

The present invention relates to a method for the light-tight packaging of a plurality of light-sensitive photographic film sheets, in particular large size graphic film sheets, and to a photographic package for such films.

In the graphic industry, large size graphic film sheets are used that are packed in sets of 50 or 100 sheets in a flat box. For the purposes of the present invention, large size films are films that have at least one dimension larger than about 60 cm.

The boxes for containing these film sheets are necessarily expensive because the weight of a stack of films is surprisingly large. For instance, a pack of 100 sheets measuring 1.20 by 1.70 m may easily reach a weight of 30 kgs. The boxes are usually made from ply-wood and massive wood, and they may comprise plastic reinforcements. The manipulation of the boxes is difficult, and requires usually the intervention of two persons. Finally, the storage of the boxes forms a problem since the horizontal storage of a plurality of boxes involves the risk of pressure fog at the central area of the films, whereas the vertical storage involves the risk for undulating deformation of the film sheets, once a number of sheets have been removed from the box.

The present invention aims to provide an improved method for the packaging of photographic films of the described kind.

According to the present invention a method for the light-tight packaging of a plurality of light-sensitive photographic film sheets, is characterized thereby that it comprises the successive steps of winding a web of opaque film sheet separating material as a roll onto a core, introducing the film sheets in succession between the windings of said web as said web is being wound onto the core, and rotatably journalling said roll of wound material in a light-tight box.

Depending on the stiffness of the film sheets that are packaged, the separation between the leading and the trailing edges of successive sheets may be small to neglectable, so that the curvature of the separating web is almost not disturbed at the cross-over between the leading and trailing edges of successive sheets, whereby the risk for pressure marks on a film sheet that overlies such cross-over zone, is overcome. As small to neglectable separations are considered distances between 1 and 30 mm.

The tension of the separating web plays also a role in the quality of the coiled film sheets, and it has been found that a reduced winding tension of the web reduces the risk for pressure marks on the film sheets. As a reduced winding tension is considered in the present specification, a tension down to 500 g per meter width of the web.

The present invention comprises also a novel photographic film package.

According to the present invention, a photographic film package, comprising an elongated generally rectangular box, a core that is rotatably journalled at both its ends in said box, photographic light-sensitive film material wound onto said core and a light-tight cover on said box that gives in the opened position acces to the box for the withdrawal of the wound film material for the core, is characterized thereby that said photographic material is in the form of separate sheets that are located in succession between the adjacent windings of a film sheet separating web that is wound onto the core.

The film sheet separating web combines different functions in a film package according to the invention. First, it enables the easy dispensing of the film sheets, one after the other, without any need to touch such film sheet while unwinding the roll. This is distinct from the known dispensers for graphic film wherein the film itself must be gripped to unwind it, to cut it, and to re-insert the cut end into the box. Second, it smoothens the cross-over between the adjacent leading and trailing edges of successive sheets so that said edges, which destroy the truly circular form of the corresponding winding of the roll, do not harm the film sheet that occupies the next outer winding of the roll. Finally, the web forms an effective protection of the light-sensitive side of the film sheets against defects caused by particles of the dust and the like that are present on that side and that may move thereon under the influence of film displacements during the transport and the handling of the film package.

In a suitable embodiment of the invention, the separating web is a black pigmented paper web, that has the advantage of improving the light-tightness of the film package, and that may be easily torn off by the operator once the required film sheet(s) has or have been withdrawn from the box.

According to a further suitable embodiment of the invention, the length of the wound film sheets corresponds with the width of the separating web. In that way, a wound roll is obtained with smooth flat end faces that is less liable to damage upon unwinding than does a roll wherein the edges of the separating web would overlap the corresponding side edges of the film sheets. The term "length" of the film sheets stands in the present description for the dimension of the film sheets that is transverse with respect to the separating web.

The film sheets may be disposed between the web windings so that their length or their width runs parallel with the axis of the core. The curling tendency of the unwound film may thus be directed width- or lengthwise of the film, and the preference for either one of these directions is with the final user of the film sheets.

Finally, the present invention comprises also a method of dispensing light-sensitive photographic film sheets from a photographic film package as described hereinbefore, which comprises the steps of opening in the darkroom the light-tight cover of the package, pulling the separating web by hand from the film package until the outermost wound film sheet is no longer engaged between the windings of the web, removing said film sheet from the package, and cutting or tearing the removed separating web at a position such that a web length is left that leads the leading edge of the next wound film sheet.

The invention will be described hereinafter by way of example with reference the accompanying drawings wherein.

Figure 1:
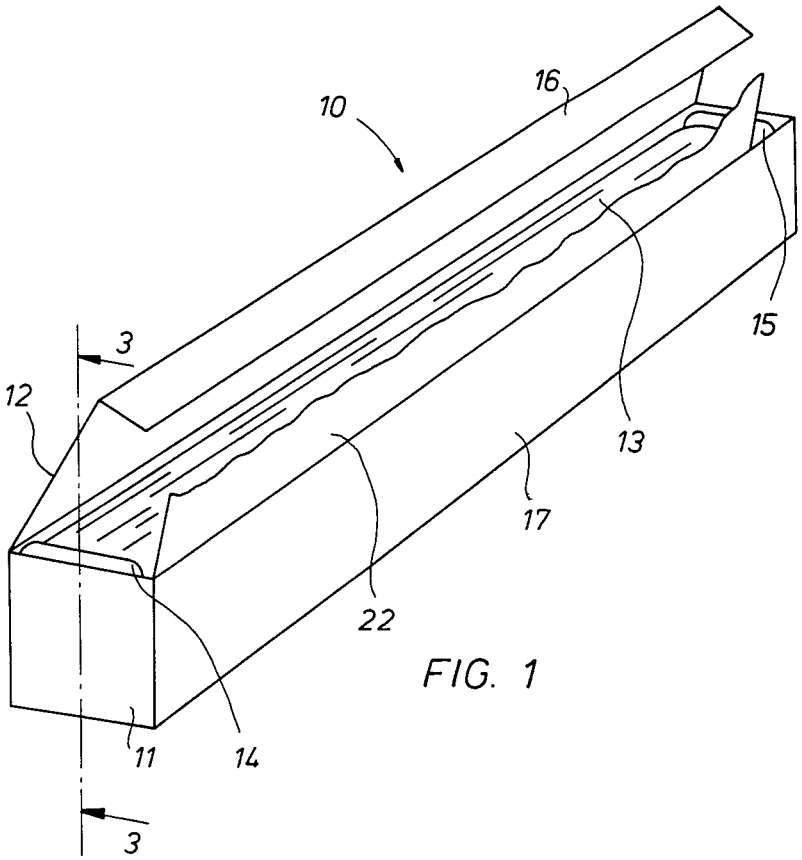
FIG. 1 is a perspective view of one embodiment of a photographic film package according to the invention, the lid or cover of the box being removed.

ferring to the opened film package or carton 10 n in FIG. 1, the package comprises a rectangular 11 with a hinged top panel or cover 12, and a roll 13 wound material that is rotatably journalled between o flanges 14 and 15 in the box.

Figure 2:
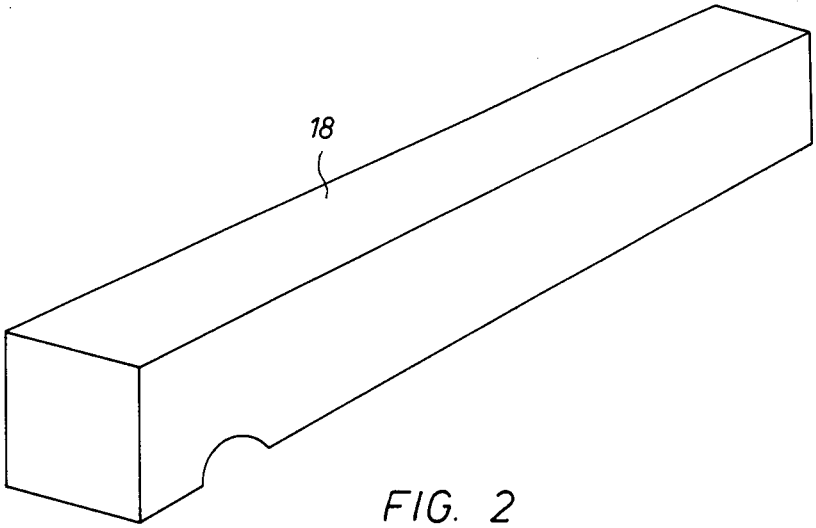
FIG. 2 is the telescope lid of the box of FIG. 1.

For the closing of the box, the tuck or tongue 16 of the panel 12 is inserted between the front wall 17 of the box and the roll of material, and then the cover 18, which is a fully telescoping lid, see FIG. 2, is placed over the box.

The box and the telescoping lid are preferably made from corrugated cardboard, but other suitable materials may as well be considered for the manufacturing of the box.

Figure 3:
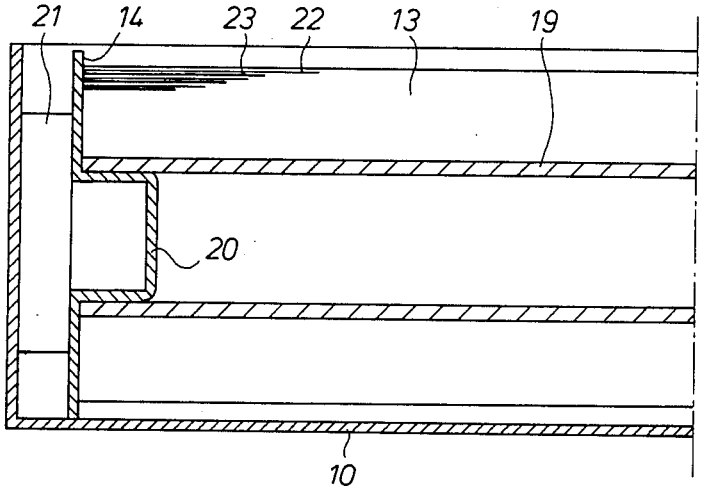
FIG. 3 is a cross-sectional view on line 3—3 of FIG. 1.

A detailed view of the rotational journalling of the roll of material in the box is shown in FIG. 3 which is a vertical cross-section on line 3—3 of FIG. 1.

The roll 13 of wound material has a core 19 of cardboard or the like that slideably fits over the cylindric hub 20 of the stationary end flange 14. The flange 14, as well as the opposite identic flange 15, is suitably made in plastic by injection moulding. The flanges have a square form and tightly fit between the front and the rear wall of the box. There may occasionally be provided spacer bodies, such as spacer 21 between either flange and the corresponding end wall of the box. Such spacer bodies may have different sizes, and allow thereby the packaging of rolls with different axial lengths in one type of box, whereby the number of different box sizes may be reduced.

Figure 4:
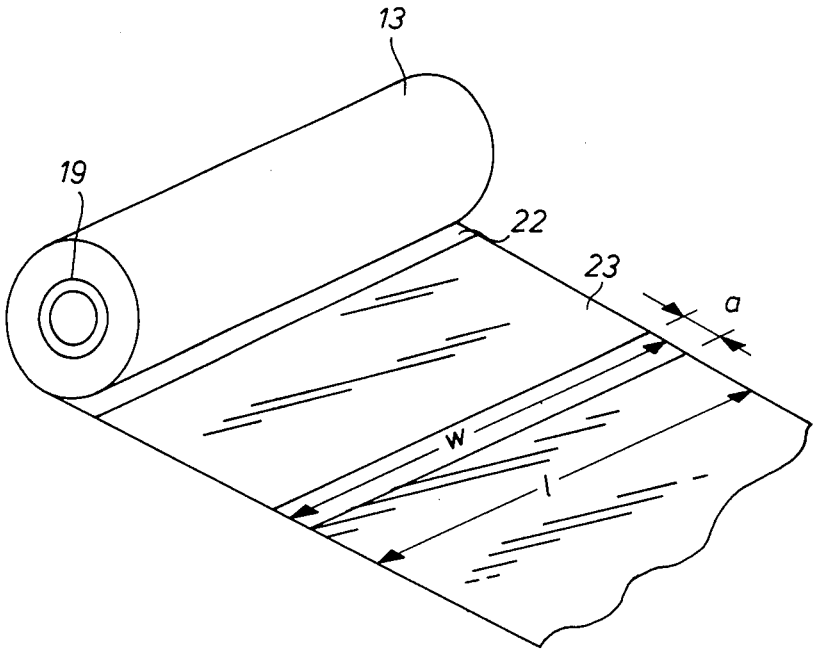
FIG. 4 illustrates a partly unrolled roll of the package according to FIG. 1.

A view of a partly unrolled roll 13 is illustrated in FIG. 4. The roll consists of a film separating and retaining web 22, in the present case a web of black pigmented paper, onto which film sheets 23 are located in succession, the spacing between the leading and the trailing edges of the successive sheets being indicated by a. The length l of the film sheets corresponds with the width w of the paper web, and also with the length of the core 19. The light-sensitive side of the film sheets faces inwardly of the roll, so that the unwound film sheets show a concave curling tendency on the light-sensitive side. In so doing, the required flatness of the sheets on a copying board or in a vacuum exposure box is easier obtained than if the film curling were towards the opposite film side.

In the production of the film package, the core 19 is mounted on a winding machine and, the paper web 22 being fixed with its leading edge to the core supplied from a roll of said paper web, the core is rotated and the film sheets are fed in succession between the windings of the paper roll, as the roll is being wound. The winding tension on the paper web is such that, in combination with the reduced spacing a between the film sheets, in the present example ranging between 10 and 30 mm, the leading and the front edges of the film sheets will not cause any harm to the next film winding under the influence of elastic recovery forces in the film. Suitable winding tensions are down to 500 g/m web width.

The roll of wound material is less compact that conventionlly wound rolls of web material, and it is possible to slightly compress the different windings by hand. Yet the winding is sufficiently tight to immobilize the distinct film sheets.

The roll of wound material is packed in an airtight and light-tight wrapping tube, the ends of which are folded over the ends of the roll, and then clamped by means of the hubs of the flanges in the core of the roll. The thus wrapped roll is placed in the box and is ready for shipment.

During the transport and handling of the box, the roll of wound material is supported with the lateral edges of both the paper web and the film sheets, on the flanges 14 and 15, and as a consequence of said simultaneous contact the wound film sheets do not suffer damage by an occasional less delicate handling of the box.

At the first use of a film package according to the invention, the roll of wound film is first taken out of the box in the darkroom, the wrapping foil is removed from the roll, and then the roll is replaced in the box with the flanges properly fitting between the walls of the box, and the box is closed.

If a film sheet is to be dispensed from the box, the telescoping lid is removed from the box, the hinged panel or cover 12 is opened, and the roll is rotated by pulling the paper web 22 until a film sheet is released from the roll. Then the paper web is torn off, preferably in such a way that a leading portion with a length of some tens of centimeters is left, and the leading end is folded over the roll of material whereupon the panel 12 is closed by inserting the tongue in the box. In this condition an effective protection against dust and soiling of the roll is obtained, though the package should remain in darkroom conditions. If the cover 18 is replaced on the box, darkroom conditions are no longer required.

It should be understood that the film package according to the invention is not limited to the described embodiment.

The box may have other configurations than the illustrated one. The hinged panel 12 may be omitted.

The film may be wound with its light-sensitive side facing outwardly of the roll, in those circumstances wherein such winding is more suited for the handling of the removed film.

Finally, the package according to the invention may as well comprise film material other than graphic film, for instance large size light-sensitive film sheet for use in the silver halide diffusion transfer process.

We claim:

1. Photographic film package for storing and dispensing undeveloped sheets of photographic sheets, comprising an elongated generally rectangular carton, a core that is rotatably journalled at its ends in said carton, and an openable light-tight cover on said box that gives in the opened position access to the interior of the box, en elongated retaining web wound in a multiplicity of windings on said core, and a plurality of separate sheets of photographic material that are sandwiched in closely spaced succession between the adjacent windings of said retaining web that is wound onto the core, whereby by opening said carton cover the free end of said sheet retaining web can be accessed and the web unwound to release said sheets one at a time.

2. Photographic film package according to claim 1, wherein said carton is a set-up carton with a base section containing the roll in rotatably journalled relation, and a full telescoping lid accessing said base section.

3. Photographic film package according to claim 2, wherein said box is provided with a hinged top cover with a tongue.

4. Photographic film package according to claim 1, wherein said photographic sheet retaining web is a black pigmented paper web.

5. Photographic film package according to claim 1, wherein the photographic sheets are wound widthwise between the convolutions of the web, and wherein the width of said separating web corresponds with the length of the wound sheets.

* * * * *